US007080587B2

(12) United States Patent
Benyami et al.

(10) Patent No.: US 7,080,587 B2
(45) Date of Patent: Jul. 25, 2006

(54) ARMOR MODULE

(75) Inventors: Moshe Benyami, Haifa (IL); Samuel Friling, Kiriat Ata (IL); Sony Helvanyo, Kirvat Haim (IL)

(73) Assignee: Rafael Armament Development Authority Ltd, Baifa (IL)

( * ) Notice: Subject to any disclaimer, the term of this patent is extended or adjusted under 35 U.S.C. 154(b) by 0 days.

(21) Appl. No.: 10/285,373

(22) Filed: Oct. 31, 2002

(65) Prior Publication Data

US 2004/0083879 A1 May 6, 2004

(30) Foreign Application Priority Data

Jan. 29, 2002 (IL) ..... 147881

(51) Int. Cl.
*F41H 7/04* (2006.01)
*F41H 5/007* (2006.01)

(52) U.S. Cl. ..... 89/36.08; 89/36.02; 89/36.17

(58) Field of Classification Search ..... 89/36.07, 89/36.08, 36.02, 36.12, 36.17, 36.14; 109/49.5, 109/9, 11, 12, 13, 15, 16; 428/911, 33, 101, 428/178, 212

See application file for complete search history.

(56) References Cited

U.S. PATENT DOCUMENTS 1,508,421 A * 9/1924 Taegen ..... 89/36.02
2,318,301 A 5/1943 Eger
2,376,331 A * 5/1945 Abrams ..... 89/36.08
2,477,852 A * 8/1949 Bacon ..... 428/116
3,699,842 A * 10/1972 Grewing et al. ..... 89/36.08
3,765,299 A * 10/1973 Pagano et al. ..... 89/36.08
3,776,094 A * 12/1973 Gilles et al. ..... 109/49.5
4,036,104 A * 7/1977 Pagano et al. ..... 89/36.08
4,351,558 A * 9/1982 Mueller ..... 89/36.08
4,555,991 A * 12/1985 Bellezza ..... 109/9
4,741,244 A 5/1988 Ratner et al.
4,867,077 A 9/1989 Marlow et al.
4,957,034 A * 9/1990 Tasdemiroglu ..... 89/36.02
5,012,721 A 5/1991 Medin et al.
5,070,764 A 12/1991 Shevach et al.
5,217,185 A * 6/1993 Rucker ..... 244/121
5,370,034 A * 12/1994 Turner et al. ..... 89/36.02
5,452,641 A * 9/1995 Kariya ..... 89/36.14
5,637,824 A 6/1997 Benyami
5,641,933 A * 6/1997 Kim ..... 89/36.02
5,824,941 A * 10/1998 Knapper ..... 89/36.17
5,876,831 A * 3/1999 Rawal ..... 428/117

(Continued)

FOREIGN PATENT DOCUMENTS

DE 42 37 798 A1 5/1994

(Continued)

OTHER PUBLICATIONS

Israeli Office Action dated Dec. 9, 2004.

*Primary Examiner*—Stephen M. Johnson
(74) *Attorney, Agent, or Firm*—Katten Muchin Rosenman LLP

(57) ABSTRACT

An armor module comprising a rigid casing having a front face, a top face and a bottom face, and a plurality of multi-layer planner cassettes fixedly mounted within the casing. Each cassette has a top base plate and a bottom base plate, sandwiching between them at least a one other layer. The top base plate of an uppermost cassette constitutes the top face of the casing, and a bottom base plate of a lowermost cassette constitutes the bottom face of the casing.

22 Claims, 2 Drawing Sheets

U.S. PATENT DOCUMENTS

| | | | | |
|---|---|---|---|---|
| 5,880,394 | A * | 3/1999 | Kim | 89/36.02 |
| 6,532,857 | B1 * | 3/2003 | Shih et al. | 89/36.02 |

FOREIGN PATENT DOCUMENTS

| | | | | |
|---|---|---|---|---|
| DE | 43 97 245 | | 4/1995 | |
| DE | 197 07 160 | | 10/1998 | |
| DE | 199 56 197 | | 6/2001 | |
| EP | 0 041 271 | A1 * | 12/1981 | 89/36.02 |
| EP | 0 860 678 | | 2/1998 | |
| JP | 6-273095 | * | 9/1994 | 89/36.02 |
| WO | WO 91/12483 | * | 8/1991 | 89/36.02 |
| WO | WO 94/20811 | | 9/1994 | |

* cited by examiner

ARMOR MODULE

FIELD OF THE INVENTION

The present invention is generally in the field of an armor module to be attached on the outside of a body liable to be exposed to attack by projectiles, e.g. shaped-charged warheads and kinetic energy projectiles. Examples of bodies protectable by armor models in accordance with the present invention are, for example, land vehicles such as battle tanks, armored personnel carriers, armored fighting vehicles, armored, self-propelled guns; static structures such as buildings, above-ground portions of bunkers, containers of various nature, for the storage of fuel, chemicals, ammunitions, etc.

In particular, the present invention is concerned with the casing of such an armor module.

BACKGROUND OF THE INVENTION

A large variety of patents are concerned with the type of protection offered by an armor module namely reactive armors or passive armors. At times, there are provided combined reactive and passive armor elements.

Such armors are disclosed, for example, in U.S. Pat. Nos. 2,318,301, 4,741,244, 5,070,764, 5,637,824, and German Publication 4,237,798A1.

Prior art armor assemblies disclose an armor assembly comprising a housing (often referred to in the art interchangeably as "a tile", "a box", "a module", "casing", etc.), with one or more cassettes fixedly received in the housing in a position corresponding with an anticipated oncoming projectile.

The one or more cassettes received within the casing are usually comprised of several layers having two outer members made of an inert material, e.g. a metal plate, sandwiching between them at least one layer of explosive material, at times with several other inert materials disposed in between. Typically, the cassettes are so arranged that the axis of an impinging projectile and of a jet formed upon deformation thereof generates with the surface of the wall's structure an acute angle of about 45°.

Casings of armor modules as known heretofore typically have a rectangle section as illustrated for example in the above-mentioned U.S. Pat. Nos. 2,381,301, 5,070,764, and in the German Publication 4,237,798A1.

It is, however, appreciated that the casing is in fact a parasitic agent as far as overall weight of the armor module is concerned, since the active components of the armor module are the cassettes (reactive or passive or any combination thereof).

The arrangement of cassettes extending askew with respect to an axes of the housing has two significant drawbacks. First, adjacent top and bottom edges of a housing, the cassettes are significantly short and do not provide sufficient ballistic length, i.e. effective minimal length of the cassettes required for efficiently destroying/stopping a charged-shape projectile. This drawback is at times referred to as an end effect. As a result, when the length of an extreme top or an extreme bottom cassette is extended so as to provide the above-mentioned minimum effective length, the armor module becomes significantly larger and thus heavier as a result of increase in dimension of the housing.

A second disadvantage of the heretofore known modules is such that an essentially horizontal gap existing between neighboring modules when two modules are successively mounted on top of one another, accumulates to the end effect of an armor module.

It is an object of the present invention to provide a novel armor module comprising a new sign of a housing which overcomes the above-mentioned drawbacks whilst not deteriorating the overall ballistic performances.

SUMMARY OF THE INVENTION

In accordance with the present invention there is provided an armor module comprising a rigid casing having a front face, a top face and a bottom face, and a plurality of multi-layer planner cassettes fixedly mounted within the casing; each cassette having a top base plate and a bottom base plate, sandwiching between them at least one other layer; wherein the top base plate of an uppermost cassette constitutes the top face of the casing, and a bottom base plate of a lowermost cassette constitutes the bottom face of the casing.

A second aspect of the invention is concerned with a method of protecting a body against projectiles, the method comprises the steps of:

fitting the body on an outside thereof with at least one armor module for protection against said charge, said armor module comprises a casing having a front face, a top face and a bottom face, and a plurality of multi-layer planner cassettes fixedly mounted within the casing; each cassette having a top base plate and a bottom base plate, sandwiching between them at least a one other layer; wherein the top base plate of an uppermost cassette constitutes the top face of the casing, and a bottom base plate off a lowermost cassette constitutes the bottom face of the casing, where said front face faces an oncoming projectile.

Still a further aspect of the invention is concerned with a casing for an armor module, said casing made of a rigid material and having a front face, a top face and a bottom face, and a plurality of multi-layer planner cassettes fixedly mounted within the casing; each cassette having a top base plate and a bottom base plate, sandwiching between them at least a one other layer; wherein the top base plate of an uppermost cassette constitutes the top face of the casing, and a bottom base plate off a lowermost cassette constitutes the bottom face of the casing.

The casing is made of a rigid material, e.g. metal or composite material and may be made in different configurations. For example, the top and bottom faces may be parallel to one another or, where the casing further comprises a rear face, the front and rear faces may be parallel to one another.

In accordance with one particular embodiment, the casing has a parallelogram section and by a modification thereof, the casing has a section of a parallelogram with one or both of an opposing top and a bottom edge, being truncated, for increasing durability of the casing.

It is highly desirable that an armor, in accordance with the present invention be an add-on type suitable for retro-fit on a body.

BRIEF DESCRIPTION OF THE DRAWINGS

For better understanding the invention and to see how it may be carried out in practice, some embodiments will now be described, by way of non-limiting examples only, with reference to the accompanying drawings, in which.

DETAILED DESCRIPTION OF SPECIFIC EMBODIMENTS

Figure 1A:
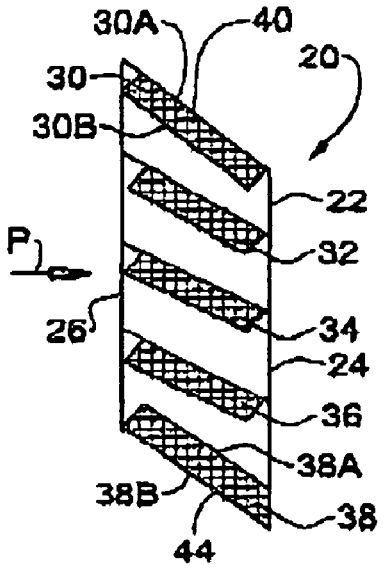
FIGS. 1A–1D are sectional views of different armor modules in accordance with different embodiments of the invention.

FIG. 1A illustrates a longitudinal section through an armor module in accordance with the present invention generally designated 20. The armor module comprises a casing 22 formed of a rigid material, say metal, or other durable material such as reinforced Kevlar™ or other composite material. The casing comprises a front face 26, a rear face 24, (the latter being an option) and a plurality of cassettes designated 30, 32, 34, 36 and 38.

As illustrated with reference to topmost and bottom most cassettes 30 and 38 respectively, each of the cassettes comprises a top base plate designated with the respective number of the cassette and an indication A and a bottom base plate indicated with a B, both plates being made of hard inert material, typically metal. The casing 22 is constructed such that a top face thereof 40 is constituted by the top base plate 30A of cassette 30 and the bottom face 44 of the casing 22 is constituted by the bottom base plate 38B of cassette 38.

The top base plate and the bottom base plate of a casing are non-inert members, made of metallic or non metallic materials. Sandwiched between top and bottom base plates of each of the cassettes there is a reactive or passive material (also referred to in the art as energetic or non-energetic material, respectively), depending on the type of the cassette which may differ between various types of passive and reactive armor cassettes as known per se.

As illustrated in FIG. 1A, the armor module 20 is in the form of a parallelogram wherein the top and bottom faces 40 and 44 and the side faces 24 and 26, respectively, are parallel. However, other arrangements are possible as well, as illustrated in the examples of FIGS. 1B and 1C.

The cassettes disposed within the casing have the general structure as in connection with FIG. 1A and are generally thus arranged for engagement with an oncoming charge P.

Figure 1B:
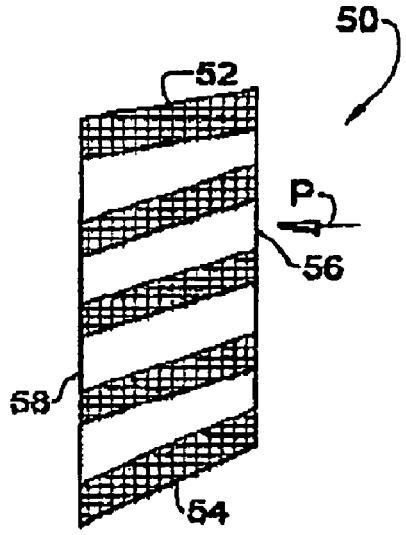

In the embodiment of FIG. 1B, there is illustrated an armor module generally designed 50 comprising the same principle structure as in FIG. 1A, however, the difference resides in that the top face 52 is not parallel with the bottom face 54 whilst the front face 56 is parallel with the rear face 58. Otherwise, and as noted, the cassettes disposed within the casing have the general structure as in connection with FIG. 1A and are generally thus arranged for engagement with an oncoming charge P.

Figure 1C:
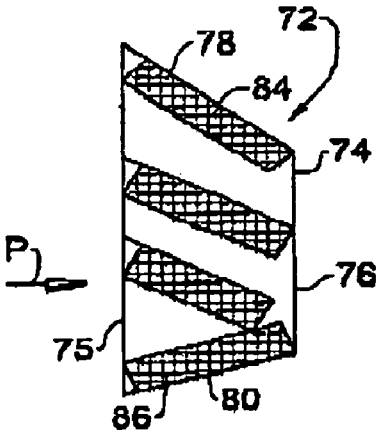

Turning now to FIG. 1C there is illustrated an armor module generally designed 72 wherein the casing 74 has a front face 75 with a rear face 76 and a top face 78 which is offset (not parallel) with respect to bottom face 80. Again, it is noticeable that the top face 78 and the bottom face 80 are constituted by a top base plate of an uppermost cassette 84 and a bottom base plate of a lowermost cassette 86, respectively.

It is further noticed that in the embodiment of FIG. 1C the plurality of cassettes disposed within the casing are arranged in a non parallel relationship. It is further appreciated that cassettes of different types may be fixed with the same casing.

Figure 1D:
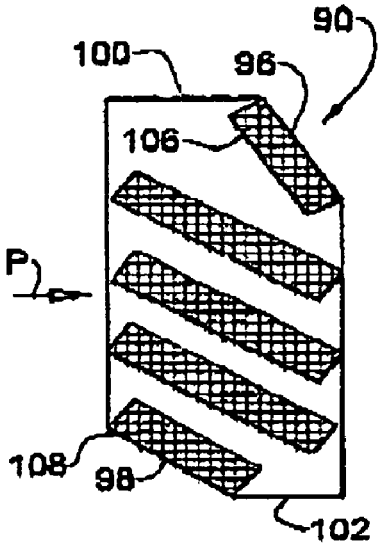

Turning now to FIG. 1D there is illustrated an armor module generally designated 90 which is principally similar to that illustrated in FIG. 1A and has the general shape of a parallelogram with the exception that both its top and bottom faces 96 and 98 are truncated at 100 and 102, respectively. It is still noted that the effective face portion of the respective top and bottom faces 96 and 98 is constituted by the respective top base plate and bottom base plate of the respective cassette 106 and 108. The outcome is that residual superfluous weight of the casing is eliminated by truncation at 100 and 102.

Figure 2:
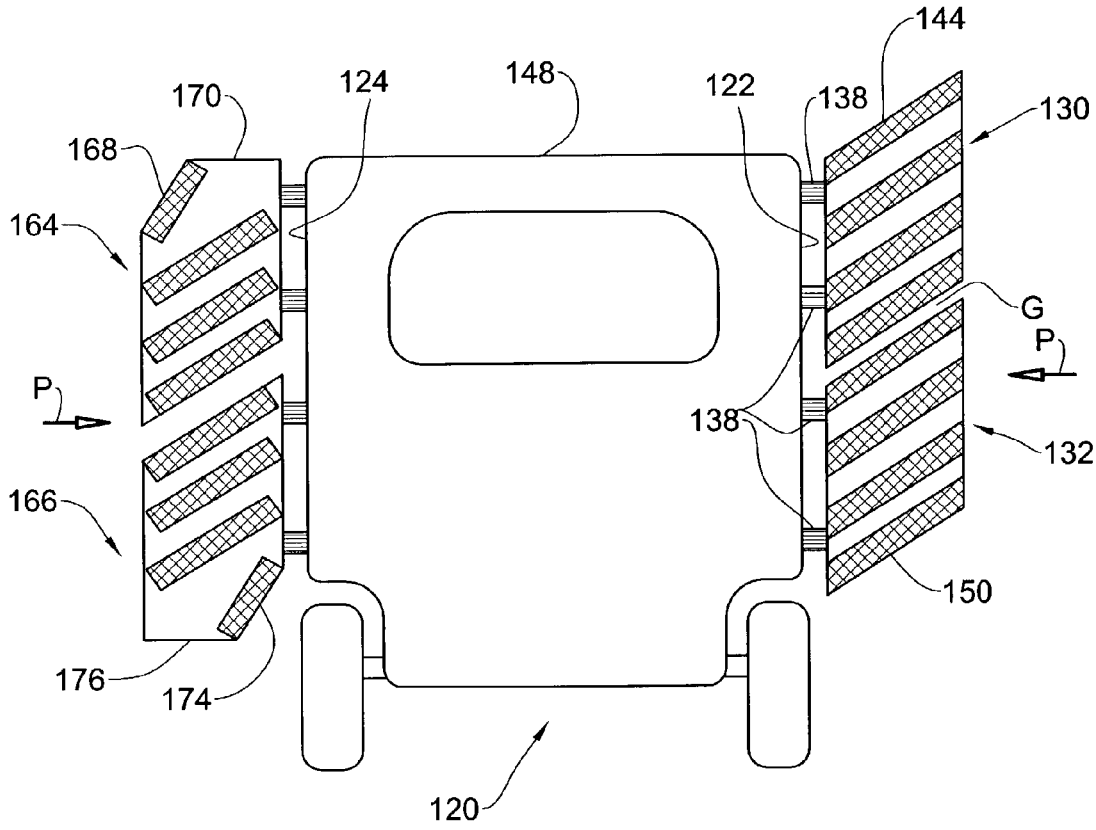
FIG. 2 is a rear view of a body, a vehicle in the particular example, fitted at two sides thereof with two different respective types of armor modules, in accordance with the present invention.

Turning now to FIG. 2 there is illustrated a body to be protected, say a personnel carrier 120 having a right surface 122 and a left surface 124. Mounted on the right surface 122 are two armor modules 130 and 132 successively mounted above one another and fixed to the surface 122 by means of fixtures 138.

Fixtures 138 may be any type of fixture as known in the art which may be a fixed arrangement or an add-on type namely, suitable for retrofit.

In the particular embodiment concerned with the right side of the vehicle, the armor module 130 and 132 correspond with the embodiment illustrated in FIG. 1A, wherein the expected oncoming projectile is generally designated by P.

It is noticed that between the top armor module 130 and the bottom armor module 132 there is a narrow gap designated G which does not provide for a normally oncoming projectile P to penetrate therebetween owing to its inclination.

Further noted, the top face 144 of the top module 130 projects beyond an upper surface 148 of the personnel carrier 120 and similarly, the lower face 150 of the bottom armor module 132 extends below the effective level of the personnel carrier 120, to thereby provide maximal protection.

Turning now to the left side of the vehicle, there is illustrated an assemblage of two armor modules 164 and 166 successively mounted above one another, the former having a top face 168 truncated at 170 and the latter having a bottom face 174 with a truncated portion 176.

The arrangement of the left side of the vehicle provides effectively the same overall ballistic effect whilst it reduces the overall weight of the armor module. Even more so, it lowers the projection of the top armor module so as to minimize interference in a line of sight where same may be required, e.g. where the top face of the armor module may interfere with the operation of firearms, etc. Similarly, the bottom armor module interferes less with grand obstacles.

As already mentioned above, one is to appreciate that various combinations of armor modules are available, as illustrated above, as well as the various combinations of cassettes which may be of any desired type.

What is claimed is:

1. A method of protecting a body against projectiles and shaped-charged warheads, the method comprising the steps of:

fitting the body on an outside thereof with at least one armor module for protection against said projectiles and shaped-charged warheads, said armor module comprises a rigid casing having a front face, a top face defining a top of the casing, and a bottom face defining a bottom of the casing, wherein a plurality of multi-layer planar cassettes are fixedly mounted within the casing; each cassette having a top base plate and a bottom base plate, sandwiching between them at least a layer of one of an energetic material and a non-energetic material; wherein the cassettes comprise at least an uppermost cassette and a lowermost cassette and situated therebetween at least one intermediate cassette, wherein the cassettes are mounted within the casing in such a manner that the top face comprises the top base plate of the uppermost cassette, and the bottom face comprises the bottom base plate of the lowermost cassette, the arrangement being such that the cassettes face the projectiles and shaped-charged warheads;

wherein the casing further comprises a rear face facing the body;

wherein at least a top and a bottom armor modules are successively mounted on the outside of the body such that the bottom face of the top armor module adjoins the top face of the bottom armor module; said top and bottom faces are parallel to each other and askew with respect to the front face of the casing.

2. A method according to claim 1, wherein the lowermost cassette of the top armor module is linearly offset with respect to the uppermost cassette of the bottom armor module.

3. A method according to claim 1, wherein a perimeter of the casing of the at least one armor module is configured as a parallelogram.

4. A method according to claim 1, wherein a top face of the casing of an uppermost armor module projects above an upper edge of the body.

5. A method according to claim 1, wherein a bottom face of the casing of an lowermost armor module projects below an edge of the body.

6. A method according to claim 1, wherein a top end of the rear face of the casing of an uppermost armor module adjoins an upper edge of a portion of the body.

7. A method according to claim 1, wherein a bottom end of the rear face of the casing of a lowermost armor module adjoins a bottom edge of a portion of the body.

8. A method according to claim 1, wherein the cassettes are selected from a group comprising reactive armor cassettes and passive armor cassettes.

9. A method according to claim 1, wherein at least one of the front and rear face of the casing is parallel to an outside surface of the body.

10. A method according to claim 1, wherein the body is a vehicle or an enclosure.

11. The method of protecting a body against projectiles and shaped-charged warheads of claim 1, wherein the armor module comprises at least one intermediate cassette situated between the uppermost cassette and the lowermost cassette.

12. An armor module arrangement for protecting a vehicle from a charged projectile, the module arrangement comprising:

a plurality of armor modules mounted spaced from the vehicle, each module comprising a rigid casing wherein a plurality of multi-layer planar cassettes are fixedly mounted within the casing; each cassette having a top base plate and a bottom base plate, sandwiching between them at least a layer of one of an energetic material and a non-energetic material;

wherein the cassettes comprise an uppermost cassette and a lowermost cassette, wherein the cassettes are mounted within the casing such that the top base plate of the uppermost cassette is the top planar surface of the casing and the bottom base plate of the lowermost cassette is the bottom planar surface of the casing; and wherein a first of the plurality of armor modules is mounted on top of a second of the plurality of armor modules so that the top base plate of the second of the plurality of armor modules is substantially parallel to the bottom base plate of the first of the plurality of armor modules.

13. The armor module arrangement of claim 12, wherein the top planar surface and the bottom planar surface are parallel to one another.

14. The armor module arrangement of claim 12, wherein at least one of the casings comprises a front face and a rear face.

15. The armor module arrangement of claim 14, wherein the front and rear face of at least one of the casings are parallel.

16. The armor module arrangement of claim 14, wherein a perimeter of at least one of the casings is configured as a parallelogram.

17. The armor module arrangement of claim 14, wherein at least one of the casings comprises a rear face, the rear face comprising a fixture for attaching the respective armor module to a vehicle.

18. The armor module arrangement of claim 12, wherein one of the plurality of armor modules is an add-on type.

19. The armor module arrangement of claim 12, wherein at least two cassettes of the plurality of cassettes in the respective casing are not parallel to each other.

20. The armor module arrangement of claim 12, wherein at least two cassettes of the plurality of cassettes in the respective casings are parallel to each other.

21. The armor module arrangement of claim 12, wherein at least one of the casings comprises a front face and wherein at least one of the cassettes mounted within the at least one of the casings is askew with respect to the front face of the at least one of the casings.

22. The armor module of claim 12, wherein at least on of the armor module comprises at least one intermediate cassette situated between the uppermost cassette and the lowermost cassette of the respective armor module.

* * * * *